US006957767B2

(12) United States Patent
Aupperle et al.

(10) Patent No.: US 6,957,767 B2
(45) Date of Patent: Oct. 25, 2005

(54) RFID-KEYED MAILBOX, AND RFID-BASED SYSTEM AND METHOD FOR SECURING A MAILBOX

(75) Inventors: Bryan Eric Aupperle, Cary, NC (US); Carol Eddy Aupperle, Cary, NC (US); James M. Mathewson, II, Chapel Hill, NC (US)

(73) Assignee: International Business Machines Corporation, Armonk, NY (US)

( * ) Notice: Subject to any disclaimer, the term of this patent is extended or adjusted under 35 U.S.C. 154(b) by 101 days.

(21) Appl. No.: 10/609,979

(22) Filed: Jun. 30, 2003

(65) Prior Publication Data

US 2005/0006452 A1 Jan. 13, 2005

(51) Int. Cl.[7] ..... B65G 11/04

(52) U.S. Cl. ..... 232/45; 232/34; 232/39; 340/569; 340/568.1; 340/5.73

(58) Field of Search ..... 232/34–37, 39, 232/17, 45; 340/568.1, 569, 568.8, 539.1, 340/539.13, 5.73

(56) References Cited

U.S. PATENT DOCUMENTS

| | | | | |
|---|---|---|---|---|
| 2,465,935 | A | 3/1949 | Scalia | |
| 3,593,914 | A | 7/1971 | Orden | |
| 4,114,801 | A | 9/1978 | Van Orden | |
| 5,632,441 | A | 5/1997 | Toval | |
| 5,954,264 | A | 9/1999 | Keller | |
| 6,323,782 | B1 * | 11/2001 | Stephens et al. | 340/10.31 |
| 6,483,433 | B2 * | 11/2002 | Moskowitz et al. | 340/568.1 |
| 6,770,831 | B1 * | 8/2004 | Rojas et al. | 209/584 |
| 2002/0113703 | A1 * | 8/2002 | Moskowitz et al. | 340/568.1 |
| 2003/0057270 | A1 * | 3/2003 | Collen | 235/375 |
| 2003/0105729 | A1 * | 6/2003 | Waxler | 705/404 |
| 2003/0163470 | A1 * | 8/2003 | Wadley | 707/9 |
| 2004/0164168 | A1 * | 8/2004 | Washington et al. | 235/486 |

* cited by examiner

*Primary Examiner*—William L. Miller
(74) *Attorney, Agent, or Firm*—Ronald A. D'Alessandro; Jerry W. Herndon

(57) ABSTRACT

Under the present invention, a mailbox is equipped with a RFID reader. The RFID reader receives a continuously transmitted signal from an RFID tag that contains an RF identifier. Upon receipt, the RFID reader compares the RF identifier in the signal to an RF identifier assigned to the mailbox. If a match is established, the mailbox is unlocked and access is permitted.

35 Claims, 3 Drawing Sheets

RFID-KEYED MAILBOX, AND RFID-BASED SYSTEM AND METHOD FOR SECURING A MAILBOX

BACKGROUND OF THE INVENTION

1. Field of the Invention

In general, the present invention provides a RDIF-keyed mailbox and an RFID-based system and method for securing a mailbox. Specifically, the present invention controls access to a mailbox based on radio-frequency identification (RFID) technology.

2. Related Art

Every year, identity theft becomes an increasing problem. In fact, the Federal Trade Commission (FTC) has rated identity theft as the top consumer fraud complaint for several years in a row. Specifically, every year several hundred thousand identity theft complaints are made, with the financial losses estimated to be hundreds of millions of dollars. These figures do not include identify theft cases that go unreported. In general, identity theft leads to financial loss when private or personal information such as a social security number is obtained. For example, using someone's social security number, a violator can obtain credit cards, loans or even access financial accounts in the victim's name.

In many instances, personal information is stolen from a victim's mailbox. This is especially the case in rural or suburban settings where mailboxes often do not require a physical key to gain access. In such settings, the violator can simply wander down a street and take mail out of one or more mailboxes. Heretofore, many attempts have been made at providing more secure mailboxes. For example, U.S. Pat. Nos. 2,465,935; 3,593,914; 4,114,801; 5,632,441; and 5,954,264 all attempt to disclose a more secure mailbox. Unfortunately many of these attempts involve significant mechanical and/or electrical adaptation of a mailbox. Such adaptation is not only extremely costly, but it could render the mailbox unsightly. In addition, each of these attempts requires a deliberate, manual action on the part of the resident or postal worker to access the mailbox. Such a requirement could pose an undue burden on a postal worker who must access many mailboxes (e.g., hundreds) per day.

One technology gaining popularity is radio-frequency identification (RFID), which is described at "aimglobal.org/technologies/rfid/what_is_rfid.htm" (herein incorporated by reference). In general, under RFID technology, a signal is continuously and automatically transmitted from an RFID tag to an RFID reader. The RFID reader will examine the signal and determine whether an RF identifier therein matches a predetermined RF Identifier known to the RFID reader. Although RFID technology could be useful in conjunction with locks, no existing technology implements RFID technology to secure a mailbox.

In view of the foregoing, there exists a need for an improved way to secure a mailbox for both incoming and outgoing mail. Specifically a need exists for an RFID-keyed mailbox, and an RFID-based system and method for securing a mailbox. Specifically, a need exists for a postal worker and/or resident to possess an RFID tag that continuously emits a signal having a particular RFID identifier. A further need exists for an RFID reader on the mailbox to receive the signal, and compare the RF identifier therein to an RF identifier assigned to the mailbox. If a match exists, a need exists for the RFID reader to allow access to the mailbox.

SUMMARY OF THE INVENTION

In general, the present invention provides an RFID-keyed mailbox, and an RFID-based system and method for securing a mailbox are provided. Specifically, under the present invention, an RFID reader is attached to a mailbox for controlling the door thereof. A postal worker or resident (or other "authorized" person) will carry an RFID tag that continuously and automatically transmits a signal having an RFID identifier upon being activated by coming within range of the RFID reader. The signal will be received by the RFID reader. Upon receipt, the RF identifier in the signal will be compared to an RF identifier assigned to the mailbox. If a match is established access to the mailbox is permitted (i.e., the door is unlocked). The present invention can also provide various other security features. For example, every time an RF identifier is received by the RFID reader, it can be stored in a log. If a quantity of RF identifiers exceeds a predetermined threshold in a predetermined amount of time, the mailbox could remain locked and require a physical key to be opened. In addition, the RFID reader could be implemented with technology that detects when the mailbox has been removed from the post, and activate an alarm (e.g., in the residence) upon such removal.

A first aspect of the present invention provides an RFID-keyed mailbox, comprising: a mailbox; and an RFID reader attached to the mailbox for controlling a door of the mailbox, wherein the reader receives a signal containing an RF identifier that is automatically transmitted from an RFID tag, and uses the signal to control the door if the RF identifier in the signal matches an RF identifier assigned to the mailbox.

A second aspect of the present invention provides an RFID-based system for securing a mailbox, comprising: an RFID tag for automatically transmitting a signal containing an RF identifier; and a mailbox having an RFID reader for receiving the signal, and for controlling a door of the mailbox based on a comparison of the RF identifier in the signal to an RF identifier assigned to the mailbox.

A third aspect of the present invention provides an RFID-based method for securing a mailbox comprising: providing a mailbox having an RFID reader; receiving an automatically transmitted signal containing an RF identifier from an RFID tag; comparing the RF identifier in the signal to an RF identifier assigned to the mailbox; and controlling a door of the mailbox based on the comparison of the RF identifier in the signal to the RF identifier assigned to the mailbox.

Therefore, the present invention provides an RFID-keyed mailbox, and an RFID-based system and method for securing a mailbox.

BRIEF DESCRIPTION OF THE DRAWINGS

These and other features of this invention will be more readily understood from the following detailed description of the various aspects of the invention taken in conjunction with the accompanying drawings in which.

Figure 1:
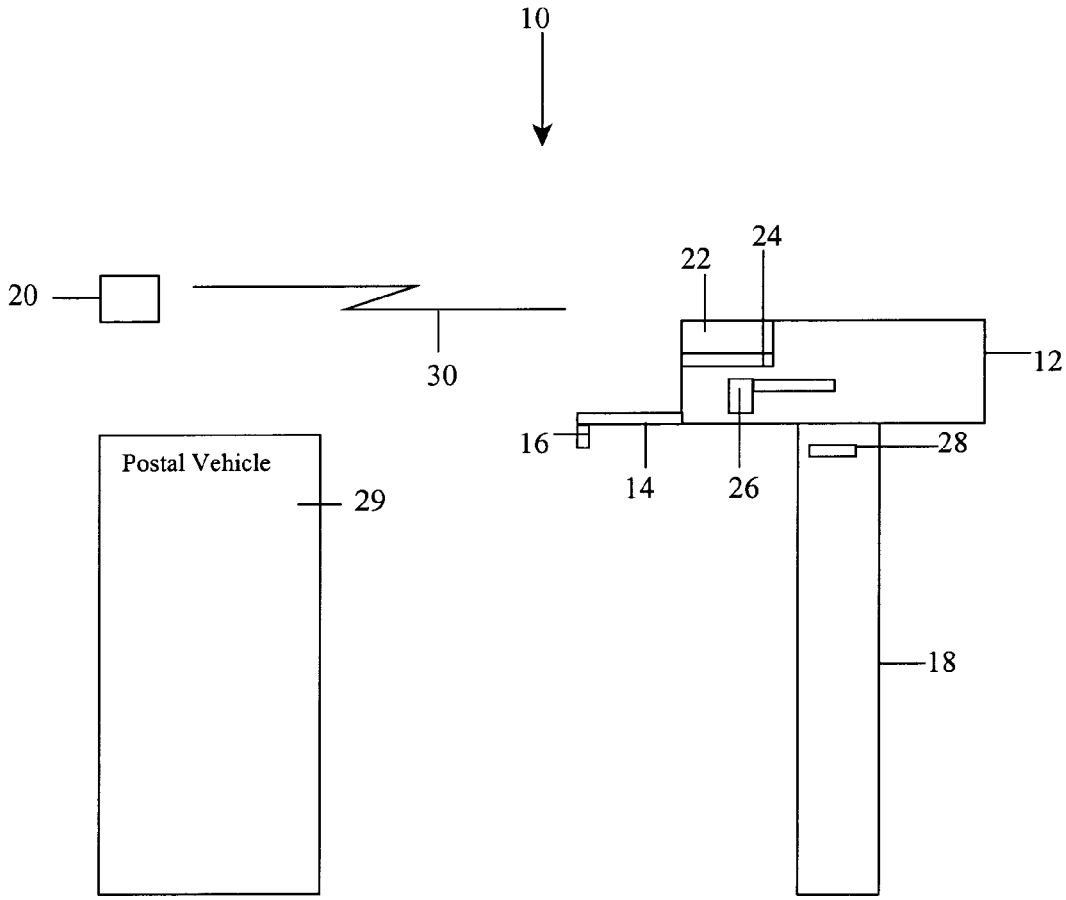
FIG. 1 depicts a mailbox having an RFID reader according to the present invention.

The drawings are merely schematic representations, not intended to portray specific parameters of the invention. The drawings are intended to depict only typical embodiments of the invention, and therefore should not be considered as limiting the scope of the invention. In the drawings, like numbering represents like elements.

DETAILED DESCRIPTION OF THE INVENTION

As indicated above, the present invention provides an RFID-keyed mailbox, and an RFID-based system and method for securing a mailbox are provided. Specifically, under the present invention, an RFID reader is attached to a mailbox for controlling the door thereof. A postal worker or resident (or other "authorized" person) will carry an RFID tag that continuously and automatically transmits a signal having an RFID identifier upon coming within range of the RFID reader. The signal will be received by the RFID reader. Upon receipt, the RF identifier in the signal will be compared to an RF identifier assigned to the mailbox. If a match is established access to the mailbox is permitted (i.e., the door is unlocked). The present invention can also provide various other security features. For example, every time an RF identifier is received by the RFID reader, it can be stored in a log. If a quantity of RF identifiers exceeds a predetermined threshold in a predetermined amount of time, the mailbox could remain locked and require a physical key to be opened. In addition, the RFID reader could be implemented with technology that detects when the mailbox has been removed from the post, and activate an alarm (e.g., in the residence) upon such removal.

Referring now to FIG. 1, an RFID-based system 10 for securing mailbox 12 is shown. As depicted, mailbox 12 includes door 14 and handle/lock 16, and is mounted on post 18. Under the present invention, mailbox 12 is also equipped with an RFID reader 22 in such a way that the basic function and appearance of mailbox 12 is not altered (e.g., flag 26 can still operate). In general, RFID reader 22 requires a power source. Accordingly, battery 24 could be provided to supply the necessary power. It should be understood, however, that other power sources could be provided. For example, RFID reader 22 could be hardwired to a power source. In any event, an RFID tag 20 is typically possessed by a postal worker and possibly by a resident of the home to which mailbox 12 pertains. To this extent, RFID tag 20 could be carried on a postal vehicle 29, within a postal bag, or carried on the person of the postal worker.

As known, RFID tag 20 is a compact device that continuously and automatically emits a signal 30 when it comes within range of RFID reader 22. Signal 30 contains a particular RF identifier that can unlock door 14 of mailbox 12. In one embodiment, the RFID tag 20 carried by postal worker could be a special "postal" tag that emits a "universal" RF identifier that can open all mailboxes, or just the mailboxes on the postal worker's route. Conversely, the RFID tag 20 possessed by a resident will only be able to open his/her mailbox 12. In any event, signal 30 will be received by RFID reader 22 and compared to an RFID identifier assigned to mailbox 12. If a match exists, door 14 is unlocked and access to mailbox 12 is granted. If a match does not exist, door 14 will remain securely closed and locked.

Figure 2:
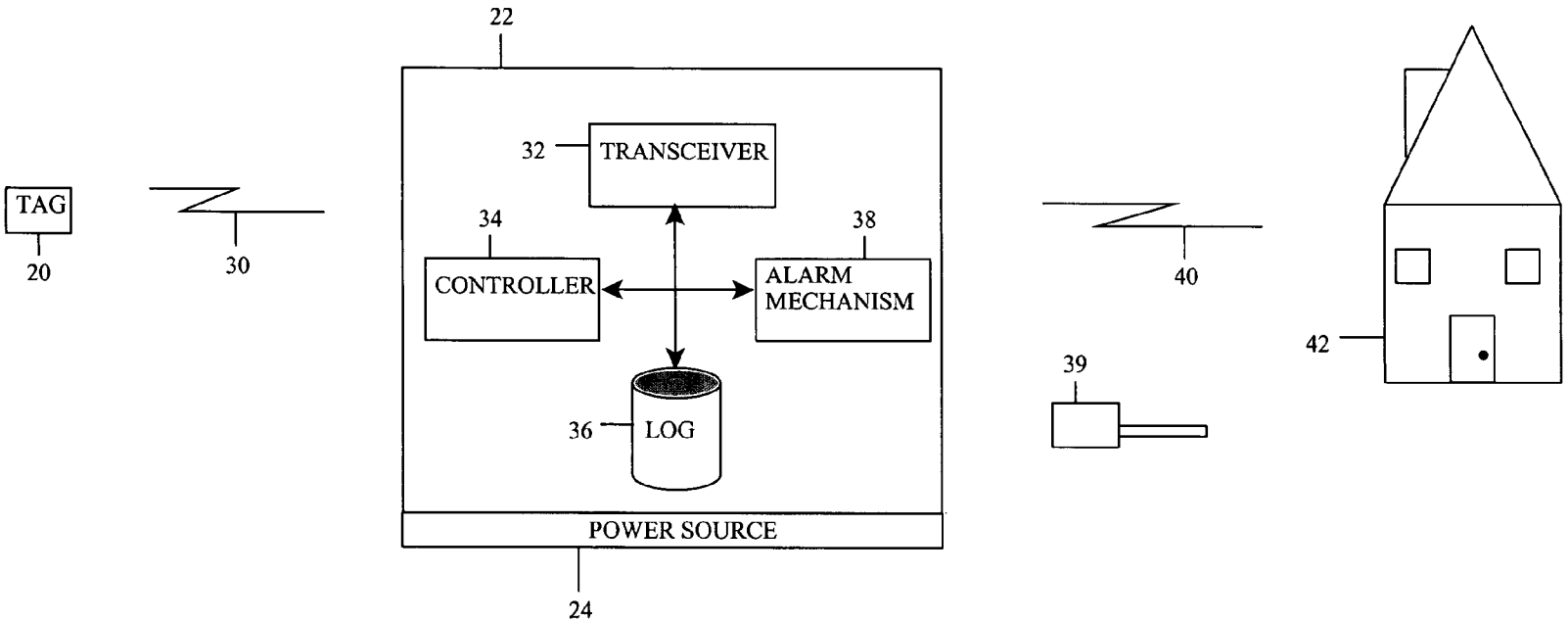
FIG. 2 depicts a more detailed diagram of the RFID reader of FIG. 1.

Referring now to FIG. 2, a more detailed diagram of RFID reader 22 is shown. As depicted, RFID reader 22 includes transceiver 32, controller 34, log 36 and alarm mechanism 38. Once tag 20 comes within "range" of transceiver 32, signal 30 will be continuously and automatically transmitted. Specifically, under a typical embodiment, tag 20 is "passive" and must receive power to generate signal 30. To this extent, transceiver 32 emits a signal that provides the necessary power to tag 20 to generate signal 30. Conversely, if tag 20 is "active," it is already powered (e.g., via a battery or the like) and need not receive a signal from transceiver to generate signal 30. In any event, once transmitted, signal 30 will be received by transceiver 32. Controller 34 will extract the RF identifier in signal 30 and compare it to the RF identifier assigned to mailbox 12. As indicated, if a match exists, controller 34 will cause actuator 35 to unlock and/or open door 14. If a match does not exist, controller 34 will ensure that door 14 remains locked. Under the present invention, the RF identifier received in signal 30 could also be stored in log 36. If a quantity of RF identifiers received in a predetermined period of time exceeds predetermined threshold door 14 could be locked by controller 34. If this happens, even the correct RF identifier will not allow access to mailbox 12, rather, a physical key 39 will be needed. This addresses the issues associated with random number generators attempting to determine the assigned RF identifier. Similarly, mailbox 12 could be locked if it is accessed too many times in a predetermined period of time. Thus, even if an intruder has the proper RFID tag 20, mailbox 12 can only be accessed a fixed number of times within the predetermined time period. In addition, under the present invention the RF identifier in signal 30 could be encrypted. Upon receiving signal 30 transceiver 32 or controller 34 could decrypt the RF identifier and make the necessary comparison to the RF identifier(s) assigned to mailbox 12. Encryption prevents an RF identifier from being pirated or cloned during transmission. To this extent, a more secure encryption scheme could be implemented in conjunction with an active tag 20.

As further shown in FIG. 1, post 18 has a transmission device 28 (FIG. 1) that interacts with alarm mechanism 38 to detect removal of mailbox 12 from post 18. Specifically, transmission device 28 could transmit a signal to alarm mechanism 38 (e.g., periodically or continuously). If mailbox 12 is removed from post 18, the signal will not be received. When this occurs, alarm mechanism 38 can transmit signal 40 to residence 42, which would cause an alarm within residence 42 to activate. For example, signal 40 could cause residence 42's security alarm to activate. Alternatively, if alarm mechanism 38 does not detect the signal from transmission device 28, a local alarm (e.g., within alarm mechanism 38) could be activated.

In another embodiment, removal of mailbox 12 from post 18 could be detected by a pair of complimentary contacts (not shown) positioned on the top of post 18 and on the bottom or underside of mailbox 12. Such contacts would appear and function similar to a pair of window or door contacts present in many home security systems. Accordingly, when mailbox 12 is removed from post 18, the interface between the contacts would be broken. At this point, the contact positioned on the mailbox would transmit a signal to alarm mechanism 38 and an alarm would be activated (e.g., within residence, or locally within alarm mechanism 38). To this extent, the contact on mailbox 12 could be hardwired to alarm mechanism 38 or it could communicate therewith via a signal.

In yet another embodiment, an alarm could be provided by placing an RFID tag in the mailbox 12 and a transceiver on post 18, or vice versa. In either case, if the transceiver stops receiving a signal, it would activate the alarm.

Still yet, mailbox 12 could include a positioning device 29 for tracking a position of the mailbox 12. This is especially helpful is mailbox 12 is removed from post 18. In a typical embodiment, positioning device 29 utilizes Global Positioning System (GPS) technology. However, it should be understood that any type of position tracking technology could be implemented. Moreover, although shown as separate components, positioning device 29 could be incorporated as part of RFID reader 22.

Figure 3:
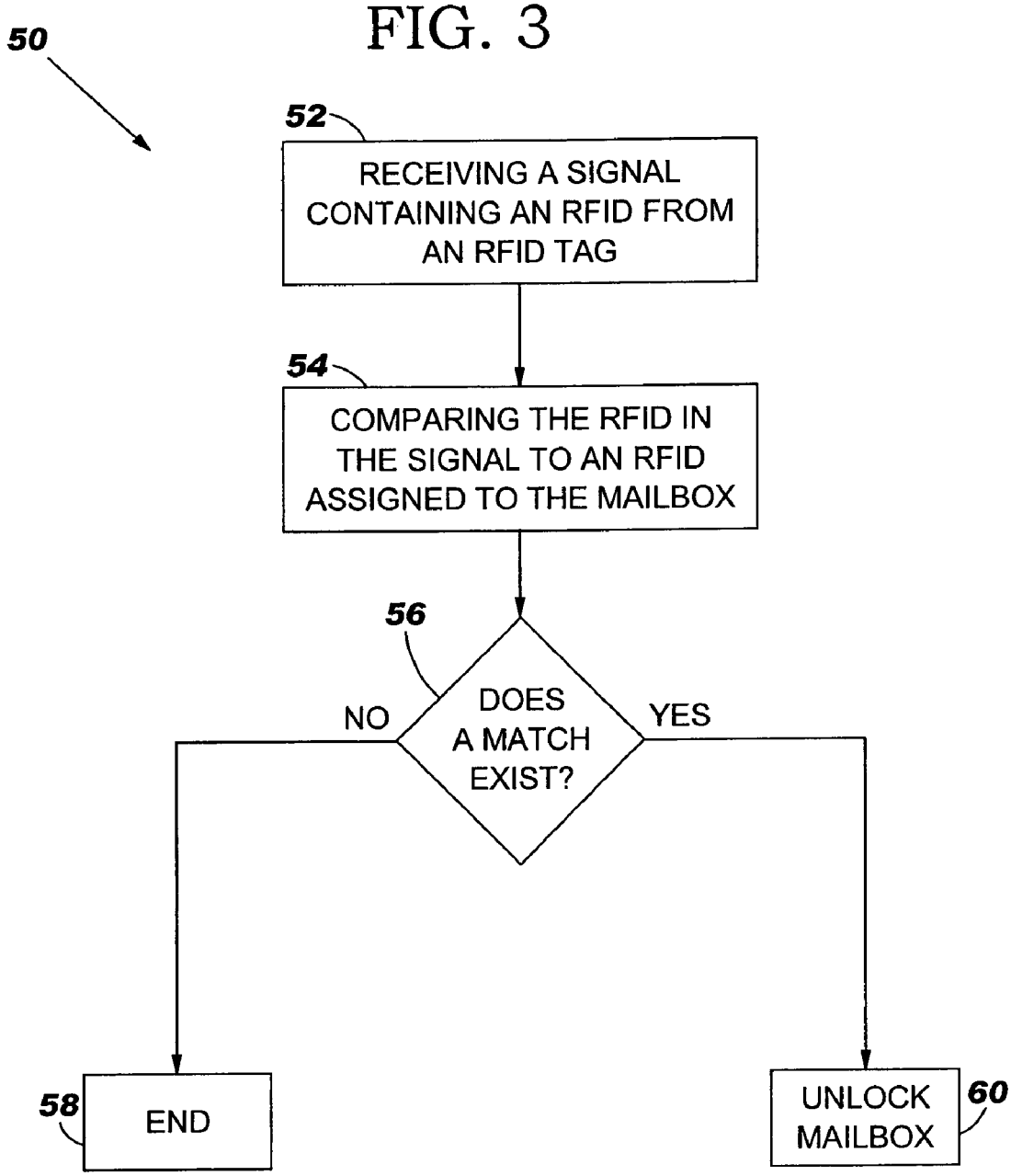
FIG. 3 depicts a method flow diagram according to the present invention.

Referring now to FIG. 3, a flow diagram of an RFID-based method 50 for securing a mailbox is shown. As depicted, first step 52 is to receive a signal containing an RF identifier from an RFID tag. Second step 54 is to decrypt the RF identifier (if encrypted) and compare the RF identifier to an RF identifier assigned to the mailbox. If, a match exists in step 56 the mailbox would be unlocked in step 60. If, however, a match does not exist, the process is ended in step 58.

It should be understood that the present invention can be realized in hardware, software, or a combination of hardware and software. To this extent, the teachings of the present invention could be implemented through software-based or hardware-based means within the RFID components (RFID tag 20 and/or RFID reader 22) Any kind components adapted for carrying out the methods described herein—are suited. A typical combination of hardware and software could be a component with a computer program that, when loaded and executed, carries out the respective methods described herein. Alternatively, a specific use component, containing specialized hardware for carrying out one or more of the functional tasks of the invention, could be utilized. The present invention can also be embedded in a computer program product, which comprises all the respective features enabling the implementation of the methods described herein, and which—when loaded in a computer system—is able to carry out these methods. Computer program, software program, program, or software, in the present context mean any expression, in any language, code or notation, of a set of instructions intended to cause a system having an information processing capability to perform a particular function either directly or after either or both of the following: (a) conversion to another language, code or notation; and/or (b) reproduction in a different material form.

The foregoing description of the preferred embodiments of this invention has been presented for purposes of illustration and description. It is not intended to be exhaustive or to limit the invention to the precise form disclosed, and obviously, many modifications and variations are possible. Such modifications and variations that may be apparent to a person skilled in the art are intended to be included within the scope of this invention as defined by the accompanying claims. For example, although RFID reader 22 communicates with residence 42 via signal 40, other alternatives are possible. For example, RFID reader 22 could be hardwired to residence 42.

We claim:

1. An RFID-keyed mailbox, comprising:

a mailbox having a door;

an RFJD reader attached to the mailbox for controlling the door of the mailbox, wherein the reader receives a signal containing an RF identifier that is automatically transmitted from an RFID tag, and uses the signal to control the door if the RF identifier in the signal matches an RF identifier assigned to the mailbox; and a log for storing the RF identifier in the signal, wherein the door requires a physical key to be controlled if a quantity of RF identifiers in the log exceeds a predetermined threshold within a predetermined amount of time.

2. The mailbox of claim 1, wherein the reader comprises:

a transceiver for receiving the signal; and a controller for unlocking the door based on a comparison of the RF identifier in the signal to the RF identifier assigned to the mailbox.

3. The mailbox of claim 1, further comprising an alarm mechanism for detecting removal of the mailbox, and activating for an alarm if the mailbox is removed.

4. The mailbox of claim 3, wherein the alarm mechanism detects removal of the mailbox from a post on which it is mounted.

5. The mailbox of claim 1, wherein the door requires a physical key to be controlled if the mailbox is removed.

6. The mailbox of claim 1, wherein the RFID tag is adapted to be carried by a postal worker.

7. The mailbox of claim 1, wherein the RFID tag is carried by a postal vehicle.

8. The mailbox of claim 1 wherein the RFID reader responds to at least two RFID signals to open the door of the mailboxes.

9. The mailbox of claim 8 wherein at least one of the at least two RFID signals controls the opening of plural mailboxes.

10. The mailbox of claim 8 wherein one of the at least two RFID signals controls the opening of a single mailbox.

11. An RFID-keyed mailbox, comprising:

a mailbox having a door; and an RFID reader attached to the mailbox for controlling the door of the mailbox, wherein the reader receives a signal containing an RF identifier that is automatically transmitted from an RFID tag, and uses the signal to control the door if the RF identifier in the signal matches an RF identifier assigned to the mailbox, wherein the RF identifier in the signal is encrypted prior to transmission from the RFID tag, and wherein the RFID reader decrypts the RF identifier in the signal upon receipt of the signal; and a log for storing the RF identifier in the signal, wherein the door requires a physical key to be controlled if a quantity of RF identifiers in the log exceeds a predetermined threshold within a predetermined amount of time.

12. An RFID-keyed mailbox, comprising:

a mailbox having a door; and an RFID reader attached to the mailbox for controlling the door of the mailbox, wherein the reader receives a signal containing an RF identifier that is automatically transmitted from an RFID tag, and uses the signal to control the door if the RF identifier in the signal matches an RF identifier assigned to the mailbox, wherein the RFID reader further comprises an electronic positioning device for tracking a position of the mailbox.

13. An RFID-based system for securing a mailbox, comprising:

an RFID tag for automatically transmitting a signal containing an RF identifier; and a mailbox having a door and an RFID reader for receiving the signal, and for controlling the door of the mailbox based on a comparison of the RF identifier in the signal to an RF identifier assigned to the mailbox, wherein the mailbox is mounted on a post, and wherein the RFID reader comprises an alarm mechanism for detecting removal of the mailbox from the post, and for activating an alarm upon removal.

14. The system of claim 13, wherein the RFID tag is adapted to be carried by a postal worker.

15. The system of claim 13, wherein the RFID tag is carried by a postal vehicle.

16. The system of claim 13, wherein the RFID reader comprises:

a transceiver for receiving the signal from the RFJD tag; and a controller for unlocking the door based on a comparison of the RF identifier in the signal to the RF identifier assigned to the mailbox.

17. The system of claim 13, wherein the door requires a physical key to be controlled if the mailbox is removed.

18. The system of claim 13, wherein the RF identifier in the signal is encrypted prior to transmission from the RFID tag, and wherein the RFID reader decrypts the RF identifier in the signal upon receipt of the signal.

19. The system of claim 13, wherein the RFID reader further comprises a positioning device for tracking a position of the mailbox.

20. The system of claim 13, further comprising a log for storing the RF identifier in the signal, wherein the door requires a physical key to be controlled if a quantity of RF identifiers in the log exceeds a predetermined threshold within a predetermined amount of time.

21. The system of claim 13 wherein the RFID reader responds to at least two RFID signals to open the door of the mailbox.

22. The system of claim 21 wherein at least one of the at least two RFID signals controls the opening of plural mailboxes.

23. The system of claim 21 wherein one of the at least two RFID signals controls the opening of a single mailbox.

24. An RFID-based method for securing a mailbox; comprising:

providing a mailbox having an RFID reader;

receiving an automatically transmitted signal containing an RF identifier from an RFID tag;

comparing the RF identifier in the signal to an RF identifier assigned to the mailbox;

controlling a door of the mailbox based on the comparison of the RF identifier in the signal to the RF identifier assigned to the mailbox; and storing the RF identifier in the signal in a log, wherein the door requires a physical key to be controlled if a quantity of RF identifiers in the log exceeds a predetermined threshold within a predetermined amount of time.

25. The method of claim 24, wherein the controlling step comprises unlocking the door if the RF identifier in the signal matches the RF identifier assigned to the mailbox.

26. The method of claim 25, further comprising:

detecting removal of the mailbox from a pole; and activating an alarm upon removal.

27. The method of claim 25, wherein the mailbox requires a physical key to control the door if the mailbox is removed.

28. The method of claim 25, wherein the RFID reader comprises a positioning device for monitoring a position of the mailbox.

29. The method of claim 25, wherein the RFID tag is adapted to be carried by a postal worker.

30. The method of claim 25, wherein the RFID tag is carried by a postal vehicle.

31. The method of claim 25, further comprising decrypting the RF identifier in the signal after receiving the signal.

32. The method of claim 25, wherein the RFID reader comprises:

a transceiver for receiving the signal from the RFID tag; and a controller for unlocking the door based on the comparison of the RF identifier in the signal to the RF identifier assigned to the mailbox.

33. The method of claim 24 wherein the RFID reader responds to at least two RFID signals to open the door of the mailbox.

34. The method of claim 33 wherein at least one of the at least two RFID signals controls the opening of plural mailboxes.

35. The method of claim 33 wherein one of the at least two RFID signals controls the opening of a single mailbox.

* * * * *

UNITED STATES PATENT AND TRADEMARK OFFICE

CERTIFICATE OF CORRECTION

PATENT NO. : 6,957,767 B2
DATED : October 25, 2005
INVENTOR(S) : Brian Eric Aupperle et al.

It is certified that error appears in the above-identified patent and that said Letters Patent is hereby corrected as shown below:

Column 5,
Line 57, replace "RFJD" with -- RFID --.

Signed and Sealed this

Third Day of January, 2006

JON W. DUDAS
*Director of the United States Patent and Trademark Office*